US008393911B2

(12) United States Patent
Aoki et al.

(10) Patent No.: US 8,393,911 B2
(45) Date of Patent: Mar. 12, 2013

(54) WATER SEAL PLUG AND CONNECTOR WITH THE WATER SEAL PLUG

(75) Inventors: Eiji Aoki, Shizuoka (JP); Tomokazu Yamane, Shizouka (JP); Yosuke Inoue, Saga (JP)

(73) Assignees: Yazaki Corporation, Tokyo (JP); NOK Corporation, Tokyo (JP)

( * ) Notice: Subject to any disclaimer, the term of this patent is extended or adjusted under 35 U.S.C. 154(b) by 0 days.

(21) Appl. No.: 13/260,196

(22) PCT Filed: Apr. 30, 2010

(86) PCT No.: PCT/JP2010/057983

§ 371 (c)(1),
(2), (4) Date: Nov. 8, 2011

(87) PCT Pub. No.: WO2010/134450

PCT Pub. Date: Nov. 25, 2010

(65) Prior Publication Data

US 2012/0058660 A1 Mar. 8, 2012

(30) Foreign Application Priority Data

May 22, 2009 (JP) ..... 2009-124095

(51) Int. Cl.
*H01R 13/52* (2006.01)

(52) U.S. Cl. ..... 439/272

(58) Field of Classification Search ..... 439/587, 439/589, 271–273
See application file for complete search history.

(56) References Cited

U.S. PATENT DOCUMENTS 4,895,533 A * 1/1990 Yagi et al. ..... 439/278
5,295,865 A * 3/1994 Endo et al. ..... 439/271
5,351,973 A * 10/1994 Taniuchi et al. ..... 439/274
(Continued)

FOREIGN PATENT DOCUMENTS

JP 2002-050430 A 2/2002
JP 2002-124336 A 4/2002
(Continued)

OTHER PUBLICATIONS

International Search Report and Written Opinion for PCT/JP2010/057983 issued Jun. 15, 2010.

*Primary Examiner* — Briggitte R Hammond
(74) *Attorney, Agent, or Firm* — Edwards Wildman Palmer LLP

(57) ABSTRACT

A connector 10 includes a terminal 5 having an electric connecting portion 52 connected with a mating member 9 at one end of the terminal 5 so as to be placed on the mating member 9 and fastened by a bolt 11 and a nut 12 and a wire connecting portion 55 joined with a terminal end of the electric wire 6 at the other end of the terminal 5, and a connector housing 4 having a terminal receiving section 41, and a water seal plug 1 arranged around the electric wire 6 to seal watertightly the terminal receiving section 41. The water seal plug 1 includes integrally a rubber water seal member 3 and a resin member 2 made of synthetic resin. The water seal member 3 includes a cylindrical main body 30 and an outer lip 31 abutting on an inner surface of the terminal receiving section 41, and a plurality of inner lips 32*a*, 32*b*, 32*c* abutting on an outer surface of the electric wire 6. A first inner lip 32*a* at the nearest position to the terminal 5 is formed to have a lower projecting height then that of the second inner lip 32*b* and the third inner lip 32*c*.

4 Claims, 5 Drawing Sheets

U.S. PATENT DOCUMENTS

| | | | | |
|---|---|---|---|---|
| 5,720,487 | A * | 2/1998 | Kato | 439/274 |
| 5,927,725 | A * | 7/1999 | Tabata et al. | 439/587 |
| 6,132,249 | A * | 10/2000 | Saito et al. | 439/274 |
| 6,309,252 | B1 * | 10/2001 | Murakami et al. | 439/274 |
| 6,814,617 | B2 * | 11/2004 | Oota et al. | 439/589 |
| 7,207,840 | B2 * | 4/2007 | Fukushima et al. | 439/589 |
| 7,618,286 | B2 * | 11/2009 | Aoki et al. | 439/587 |
| 2006/0019535 | A1 | 1/2006 | Fukushima et al. | |

FOREIGN PATENT DOCUMENTS

| | | | |
|---|---|---|---|
| JP | 2006-032199 | A | 2/2006 |
| JP | 2007-035362 | A | 2/2007 |
| JP | 2009-187789 | A | 8/2009 |

* cited by examiner

WATER SEAL PLUG AND CONNECTOR WITH THE WATER SEAL PLUG

TECHNICAL FIELD

This invention relates to a water seal plug, which is arranged around an electric wire and fitted together into a terminal receiving section of a connector housing, and a connector having the water seal plug.

BACKGROUND ART

A connector 210 shown in FIG. 6 includes a terminal 205 having an electric connecting portion 252 connected with a mating member 9 at one end of the terminal and a wire connecting portion 255 joined with a terminal end of an electric wire 206 at the other end of the terminal, a connector housing 204 having a terminal receiving section 241 receiving the terminal 205 and the electric wire 206 joined with the terminal 205 and a water seal plug 201, which is arranged around the electric wire 206 and fitted into the terminal receiving section 241 so as to seal watertightly between an outer surface of the electric wire 206 and an inner surface of the terminal receiving section (Refer Patent Document 1).

The mating member 9 is formed for example into a terminal of an electronic device with a connecting member 92 having a plate portion 90 made of electric conductive metal and a round hole 91 arranged at the plate portion 90. The connecting member 92 is placed on a terminal block 8 arranged in an enclosure of the electronic device, and fastened on the terminal block 8 by a bolt 11 and a nut 12. The bolt 11 is inserted into the round hole 91 and previously arranged at the terminal block 8. The bolt 11 and the nut 12 are fastened in a fastening direction shown with an arrow Y (direction Y) in FIG. 6. A direction shown with an arrow X (direction X) in FIG. 6 is a direction perpendicular to the direction shown with the arrow Y.

The electric connecting portion 252 includes a plate portion 250 made of conductive metal and a round hole 251 arranged at the plate portion 250. The electric connecting portion 252 is placed on the terminal block 8 and the connecting member 92 of the mating member 9 so as to insert the bolt 11 into the round hole 251. Thus, the electric connecting portion 252 is fastened at the connecting member 92 by the bolt 11 and the nut 12 so as to be connected with the connecting member 92.

The wire connecting portion 255 includes a flat mount portion 253 extending along the direction X continuously from the plate portion 250, and a crimp piece 254 extending vertically from a side edge of the mount portion 253 for joining a core wire of the electric wire 206 placed on the mount portion 253 therewith by crimping. An outer insulation cover at an end of the electric wire 206 is removed so as to expose the core wire.

The water seal plug 201 includes a water seal portion 203 made of rubber and a resin portion 202 made of synthetic resin formed integrally with the water seal portion 203. The water seal portion 203 includes a cylindrical main body 230 passing the electric wire 206 therethrough, a plurality of ring-shape outer lips 231 projecting from an outer surface of the main body 230 and touching tightly the inner surface of the terminal receiving section 241, and a plurality of ring-shape inner lips 232 projecting from an inner surface of the main body 230 and touching tightly an outer surface of the electric wire 206. The inner lips 232 not in elastically deformed condition is shown with a chain line in FIG. 6. As shown with the chain line in FIG. 6, the plurality of inner lips 232 is formed so as to have equal projecting height from the inner surface of the main body 230. The resin portion 202 is formed into cylindrical shape and arranged inside the main body 230. The resin portion 202 is provided for preventing deformation by aged deterioration and improving stiffness of the water seal portion 203.

According to the connector 210 structured above, after the water seal plug 201 is arranged around the electric wire 206, the terminal end of the electric wire 206 is joined with the wire connecting portion 255, and the terminal 205, the electric wire 206 and water seal plug 201 are received in the terminal receiving section 241 of the connector housing 204 so that the connector 210 is assembled. The outer lips 231 of the water seal plug 201 abuts on the inner surface of the terminal receiving section 241, and deformed so as to seal water tightly between the inner surface of the terminal receiving section 241 and it. The inner lips 232 of the water seal plug 201 abuts on the outer surface of the electric wire 206, and deformed so as to seal water tightly between the outer surface of the electric wire 206 and it.

According to the above connector 210, when the electric connecting portion 252 of the terminal 205 is fastened by the bolt 11 and the nut 12, the terminal 205 and the electric wire 206 are moved about 1 mm in a direction of fastening by the bolt 11 and the nut 12, that is the direction Y. A length along the direction Y of the terminal receiving section 241 is designed to include a value of this moving of the terminal 205 and the electric wire 206. The water seal plug 201 performs not only water sealing but also preventing the terminal 205 and the electric wire 206 from rattling.

CITATION LIST

Patent Document:

Patent Document 1: Japan Patent Application Published No. 2006-32199

SUMMAERY OF INVENTION

Objects to be Solved

The connector 210 including a general water seal plug 201 structured above has following problems. Since the electric wire 206 joined with the terminal 205 is moved in the direction of fastening by the bolt 11 and the nut 12 when the electric connecting portion 252 of the terminal 205 is fastened by the bolt 11 and the nut 12, for preventing deterioration of water sealing between the electric wire 206 and the water seal plug 201, it is required that a projecting height from the inner surface of the main body 230 of the inner lip 232 is enlarged so as to increase an amount of deformation of the inner lip 232. When the projecting height of all inner lips is increased, a friction force, that is an inserting force for mounting the water seal plug 201 around the electric wire 206 becomes very large. Process for mounting the water seal plug to the electric wire 206 becomes troublesome. Additionally, when the projecting height of all inner lips 232 is enlarged, contact force of the inner lips 232 and the electric wire 206 becomes too large, so that the electric wire 206 can not easily follow moving of the terminal 205, thereby, the electric wire 206 and the terminal have large stress.

According to the above problems, an object of the present invention is to provide a water seal plug, which can seal with high water tightness and be easily mounted around an electric wire, and a connector having the water seal plug.

How to attain the Object of the Present Invention

In order to overcome the above problems and attain the object of the present invention is a water seal plug, which is arranged around an electric wire and inserted into a terminal receiving section of a connector housing of a connector so as to seal watertightly between an outer surface of the electric wire and an inner surface of the terminal receiving section, the connector having a terminal having an electric connecting portion connected with a mating member at one end of the terminal so as to be placed on the mating member and fastened by a fastening member and a wire connecting portion joined with a terminal end of the electric wire at the other end of the terminal, and the connector housing having the terminal receiving section receiving the terminal and the electric wire joined with the terminal movably along a radial direction of the electric wire parallel to a direction of fastening by the fastening member, and the water seal plug includes a cylindrical main body passing the electric wire therethrough; and a water seal member made of elastic material, having an ring-shape outer lip projecting from an outer surface of the main body and abutting on an inner surface of the terminal receiving section; and a plurality of ring-shape inner lips projecting from an inner surface of the main body and abutting on an outer surface of the electric wire, and at least one of the plurality of inner lips has a lower projecting height from the inner surface of the main body than that of the other inner lips.

In the above mentioned invention, the inner lip at a nearest position to the terminal from among the plurality of inner lips is formed to have a lower projecting height from the inner surface of the main body than that of the other inner lips.

In the above mentioned invention, the water seal plug further includes a resin member made of synthetic resin and formed integrally with the water seal member. The resin member includes a cylindrical portion having a cylindrical shape and being arranged coaxially with the main body so as to pass the electric wire therethrough and a limiting portion projecting from an inner surface of the cylindrical portion and abutting the electric wire to be moved along the direction of fastening when the electric connecting portion is fastened by the fastening member so as to prevent the electric wire from excessively moving.

In the above mentioned invention, the connector includes a terminal having an electric connecting portion connected with a mating member at one end of the terminal so as to be placed on the mating member and fastened by a fastening member and a wire connecting portion joined with a terminal end of the electric wire at the other end of the terminal, and a connector housing having a terminal receiving section receiving the terminal and the electric wire joined with the terminal movably along a radial direction of the electric wire parallel to a direction of fastening by the fastening member, and a water seal plug arranged around the electric wire and inserted into the terminal receiving section so as to seal watertightly between an outer surface of the electric wire and an inner surface of the terminal receiving section, and the water seal plug is according to claim 1, 2 or 3.

Effects of the Invention

According to the present invention, at least one of the plurality of inner lips is formed to have the lower projecting height from the inner surface of the main body than that of the other inner lips, so that the other inner lips having the higher projecting height can seal the electric wire moving along the radial direction. The inner lip having the lower projecting height can prevent increase of insertion force for arranging the water seal plug around the electric wire. Thereby, the water seal plug, which can be easily mounted around the electric wire with high water-tightness, is provided.

According to the present invention, the inner lip at the nearest position to the terminal from among the plurality of inner lips is formed to have a lower projecting height from the inner surface of the main body than that of the other inner lips. Thereby, an area of the electric wire abutting on the inner lip at the nearest position to the terminal can follow a motion of the terminal, so that it is prevented that an excessive stress is generated in the electric wire and the terminal. Between the other inner lips having the higher projecting height and the electric wire, high water-tightness can be given.

According to the present invention, the water seal plug further includes the resin member made of synthetic resin and formed integrally with the water seal member, and the resin member includes the cylindrical portion having a cylindrical shape and being arranged coaxially with the main body so as to pass the electric wire therethrough and the limiting portion projecting from the inner surface of the cylindrical portion and abutting the electric wire to be moved along the direction of fastening when the electric connecting portion is fastened by the fastening member so as to prevent the electric wire from excessively moving. Thereby, it is prevented that the water seal member is deformed by aging, and a stiffness of the water seal plug is improved. Furthermore, it is prevented that water-tightness of the inner lip is decreased by moving the electric wire excessively.

According to the present invention, the water seal plug according to claim 1, 2 or 3 is applied so that the connector, which can be easily assembled with high water-tightness, is provided.

DESCRIPTION OF EMBODIMENTS

Figure 1:
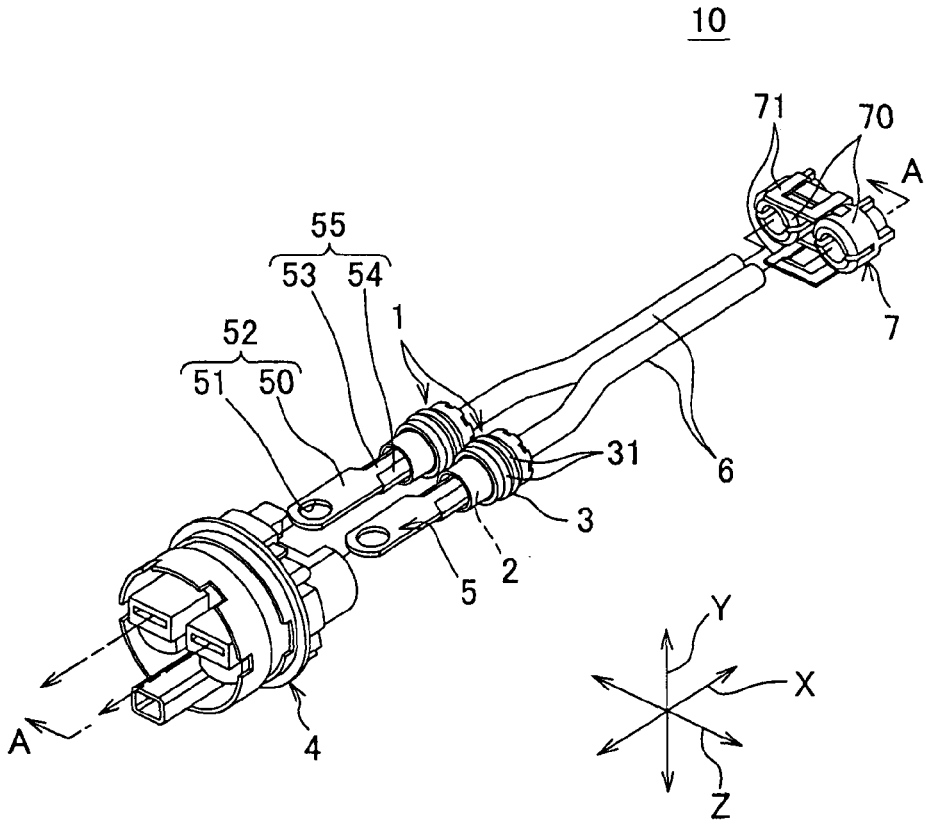
FIG. 1 is an exploded perspective view of connector having a water seal plug of one embodiment according to the present invention.
Figure 2:
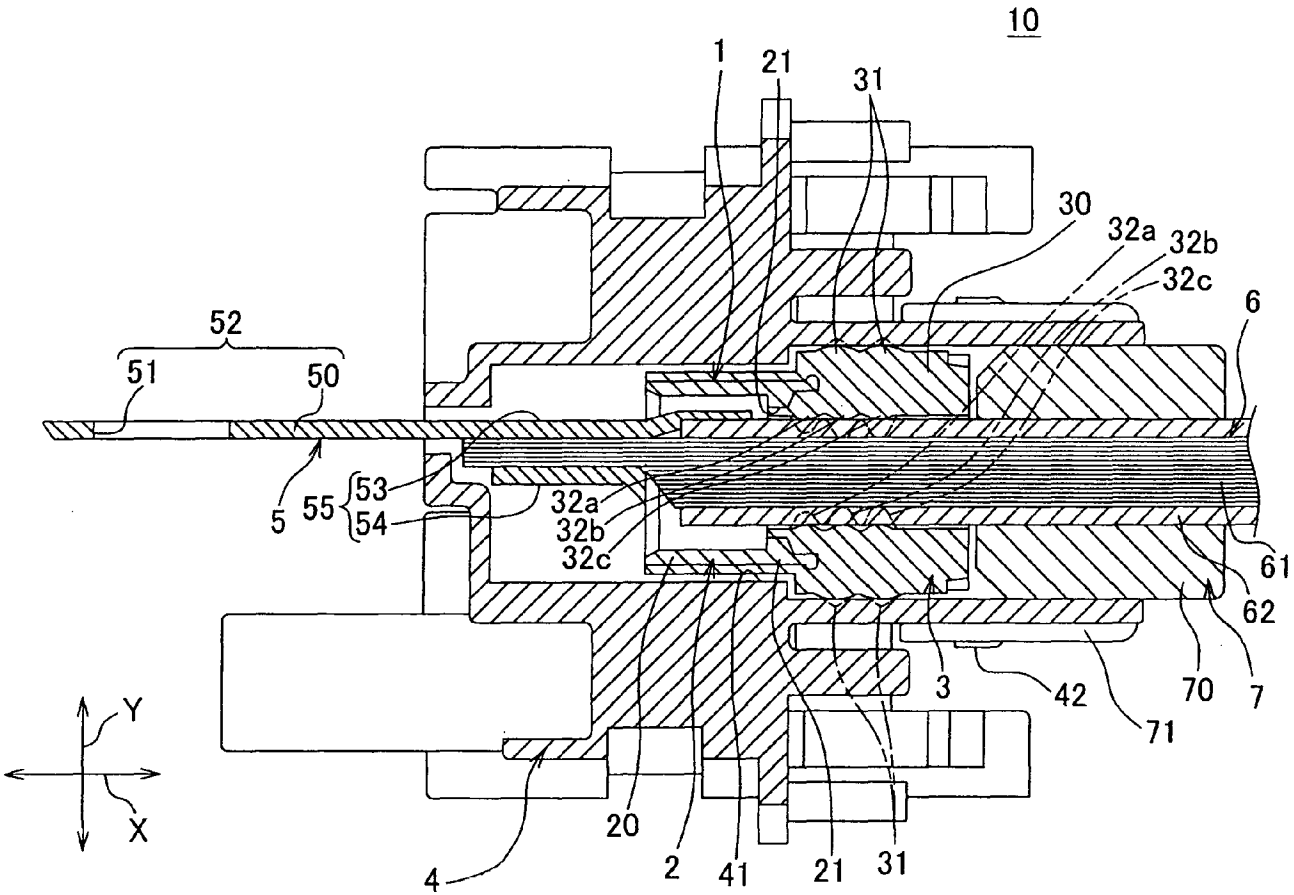
FIG. 2 is a cross-sectional view taken along the line A-A of the connector shown in FIG. 1.

A water seal plug according to one embodiment of the present invention and a connector having the water seal plug will be described with reference to FIGS. 1-5. As shown in FIGS. 1 and 2, the connector 10 includes a terminal 5 having an electric connecting portion 52 connected with a mating member 9 (refer FIG. 5) at one end of the terminal 5 and a wire connecting portion 55 joined with a terminal end of an electric wire 6 at the other end of the terminal 5; and a connector housing 4 having a terminal receiving section 41 receiving the terminal 5 and the electric wire 6 joined with the terminal 5; the water seal plug 1 arranged around the electric wire 6 and press-fitted into the terminal receiving section 41 so as to seal watertightly between an outer surface of the electric wire 6 and an inner surface of the terminal receiving section 41; and a holder 7 preventing the terminal 5 and the electric wire 6 from slipping out from the terminal receiving section 41.

Figure 5:
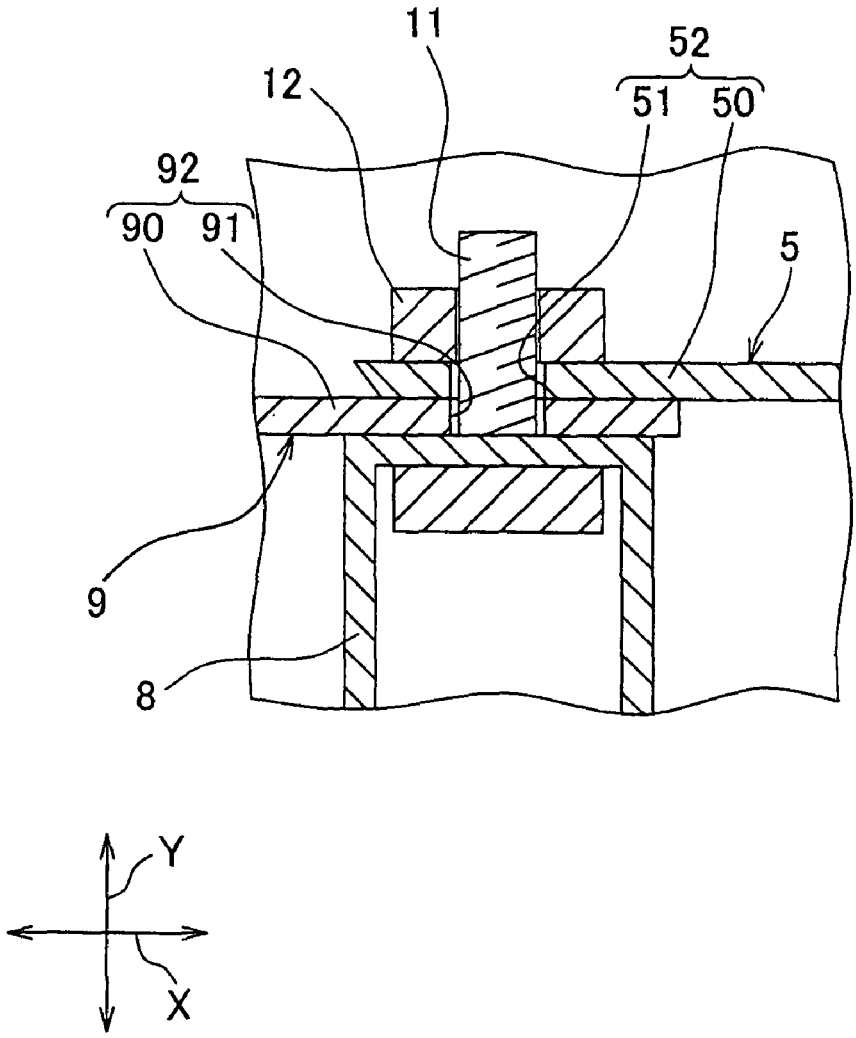
FIG. 5 is a cross-sectional view showing a condition of connecting the terminal of the connector and a mating member.
Figure 6:
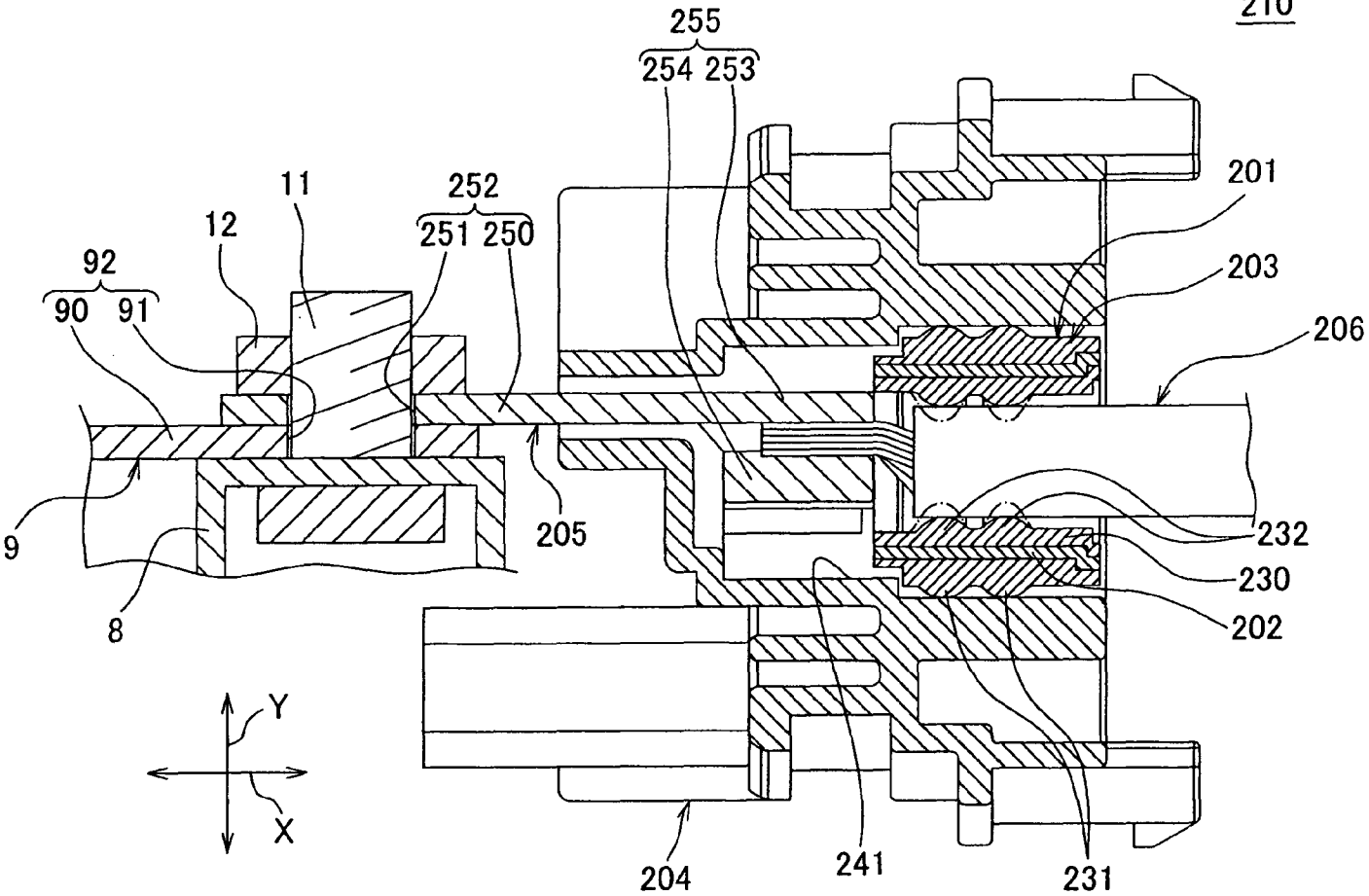
FIG. 6 is a cross-sectional view of a connector having a water seal plug by Prior Art.

The mating member 9 acts, for example as a terminal of an electronic device, and includes a connecting member 92 having a plate portion 90 formed into a flat shape with an electric conductive metal having a round hole 91 as shown in FIGS. 5.

The connecting member 92 is placed on a terminal block 8 arranged in a frame of the electronic device so as to be fixed on the terminal block by a bolt 11 and a nut 12. The bolt 11 is previously mounted at the terminal block 8 so as to be inserted through the round hole 91. A direction shown with an arrow Y in FIGS. 1-5 indicates a direction of fastening the bolt 11 and the nut 12, that is fastening members. A direction shown with an arrow X in FIGS. 1-5 (direction X) indicates a direction perpendicular to the direction shown with the arrow Y (direction Y).

The terminal 5 is formed by pressing an electric conductive metal sheet. The electric connecting portion 52 is formed with a plate portion 50 having a round hole 51. The electric connecting portion 52 projects from an opening of the connector housing 4, that is from one end of the terminal receiving section 41. The electric connecting portion 52 is placed on the terminal block 8 and the connecting member 92 of the mating member 9 so as to pass the bolt 11 through the round hole 51, and electrically connected with the connecting member 92 by fastening the bolt 11 and the nut 12. When the electric connecting portion 52 is connected with the connecting member 92, a direction of thickness of the plate portion 50 is made along the direction of fastening, that is the direction Y.

The electric connecting portion 55 as shown in FIG. 1 includes a mount portion 53 extending from the plate portion 50 along the direction X and a crimp piece 54 extending vertically from side edges in a direction Z of widthwise of the mount portion 53 so as to be electrically connected with a core wire 61 of the electric wire 6 by crimping the crimp piece 54 with the core wire 61 mounted on a top surface of the mount portion 53. The direction Z is perpendicular to both of the direction X and the direction Y. A radial direction of the electric wire 6 connected with the electric connecting portion 55 is parallel to the direction of thickness of the plate portion 50, that is the direction of fastening the bolt and the nut (the direction Y).

The electric wire 6 is a round cross-sectional covered wire, in which an outer surface of the electric conductive core wire 61 is covered by an insulation cover 62 as shown in FIG. 2. The cover 62 at a terminal end of the electric wire 6 is removed to expose the core wire 61. The electric wire 6 is drawn out from the opening of the connector housing 4, that is from the other end of the terminal receiving section 41, to an outside of the connector housing 4.

The terminal 5 is moved about 1 mm along the direction of fastening the bolt 11 and the nut 12, that is the direction Y, when the electric connecting portion 52 is fastened to the connecting member 92 and the terminal block 8 by the bolt 11 and the nut 12. Therefore, a length of the terminal receiving section 41 along the direction Y is designed to include a moving distance of the terminal 5 and the electric wire 6. Thereby, the terminal receiving section 41 can receive the terminal 5 and the electric wire 6 movably in the direction Y, that is the direction of thickness of the mount portion 53 and the plate portion 50, and the radial direction of the electric wire 6. The water seal plug 1 acts not only to prevent from liquid penetrating from the opening, through which the electric wire 6 of the connector housing 4 is drawn, that is the other end of the terminal receiving section 41, into the terminal receiving section 41, but also to prevent the terminal 5 and the electric wire 6 from rattling motion.

Figure 3:
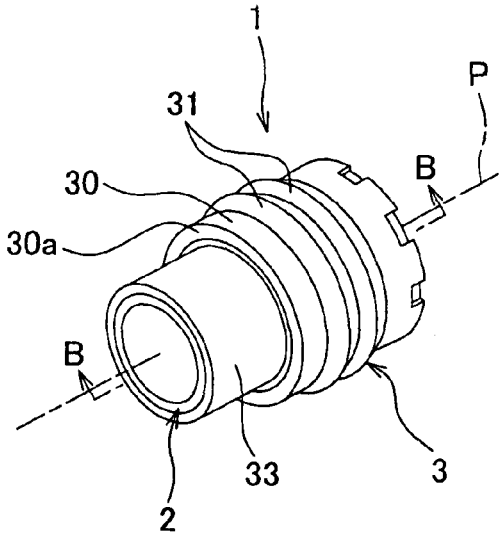
FIG. 3 is a perspective view of the water seal plug shown in FIG. 1.
Figure 4:
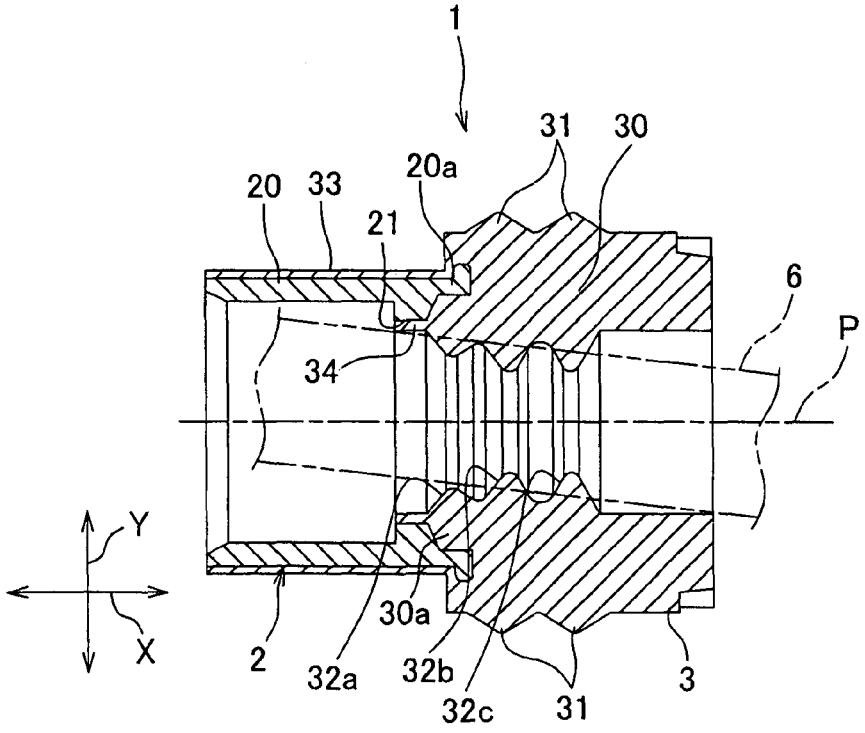
FIG. 4 is a cross-sectional view taken along the line B-B in FIG. 3.

The water seal plug 1 includes a water seal member 3 made of synthetic rubber as an elastic material and a resin member 2 made of synthetic resin to be formed integrally with the water seal member 3 as shown in FIGS. 2-4. The water seal plug 1 is produced by insert molding of inserting the resin member 2 into a molding die for the water seal member 3 and molding.

The water seal member 3 includes integrally a cylindrical shape main body 30 passing the electric wire 6 therethrough, a plurality of ring shape outer lips 31 projecting from an outer surface of the main body 30 and abutting on an inner surface of the terminal receiving section 41, a plurality of ring shape inner lips 32*a*, 32*b*, 32*c* projecting from an inner surface of the main body 30 and abutting on an outer surface of the electric wire 6, a cylindrical shape first extending portion 33 extending from one end 30*a* of the main body 30 and a cylindrical shape second extending portion 34 extending from the one end 30*a* of the main body 30. A chain line P in FIGS. 3 and 4 shows a center axis of the water seal member 3. The plurality of outer lips 31 and the plurality of inner lips 32*a*, 32*b*, 32*c* are arranged in intervals to each other along the center line P. The first extending portion 33 and the second extending portion 34 are arranged coaxially so as to locate the second extending portion 34 inside the first extending portion 33. The later described resin member 2 is arranged between the first extending portion 33 and the second extending portion 34. The electric wire of the terminal 5 is positioned inside the first extending portion 33. The plurality of outer lips 31 abuts on the inner surface of the terminal receiving section 41 and deformed so as to seal watertightly between the inner surface and it, and the plurality of inner lips 32*a*, 32*b*, 32*c* abuts on the outer surface of the electric wire 6 and deformed so as to seal watertightly between the electric wire 6 and it.

The inner lip 32*a* (call a first inner lip 32*a*) located at the one end 30*a* of the main body 30 is formed to have a lower projecting height than that of the other inner lips 32*b*, 32*c* (call a second inner lip 32*b* for the inner lip adjacent to the first inner lip 32*a*, and a third inner lip 32*c* for the inner lip farther from the first inner lip 32*a*). The second inner lip 32*b* and the third inner lip 32*c* have the same projecting height. The projecting height means a distance from the inner surface of the main body 30 to a top end of each inner lip 32*a*, 32*b*, 32*c*. The chain line shown in FIG. 2 indicates each inner lip 32*a*, 32*b*, 32*c* not in elastic deformed condition.

The resin member 2 is arranged so as to prevent from deformation by aging and improve a stiffness of the water seal member 3. The resin portion 2 includes integrally a cylindrical portion 20 passing the electric wire 6 therethrough and a ring-shape limiting portion 21 projecting from an inner surface at one end 20*a* of the cylindrical portion 20.

The cylindrical portion. 20 is arranged coaxially with the main body 30 and the first extending portion 33 and inside the first extending portion 33. The one end 20*a* of the cylindrical portion 20 is arranged inside the one end 30*a* of the main body 30 and between the first extending portion 33 and the second extending portion 34.

The limiting portion 21 is located between the first extending portion 33 and the second extending portion 34. Before the electric connecting portion 52 is fastened on the connecting member 92 and the terminal block 8 by the bolt 11 and the nut 12, the limiting portion 21 and the second extending portion 34 has a space between the electric wire 6. When the electric connecting portion 52 is fastened on the connecting member 92 and the terminal block 8 by the bolt 11 and the nut 12 and the electric wire 6 is moved along the direction of fastening the bolt 11 and the nut 12 and/or moved along the radial direction by vibration (the moved electric wire 6 is shown with a two-dot chain line in FIG. 4), by abutting on the electric wire 6, the limiting portion 21 prevents the electric wire 6 from excessively moving.

According to the present invention, the water seal plug 1 includes the limiting portion 21, so that it can be prevented that the electric wire 6 is excessively moved and water-tightness of each inner lip 32*a*, 32*b*, 32*c* is decreased. Decreasing water-tightness means that an amount of deformation of each inner lip 32*a*, 32*b*, 32*c* is decreased and a gap between each inner lip 32*a*, 32*b*, 32*c* and the electric wire 6 is generated. According to the present invention, the second extending portion 34 is not always required.

The above structured water seal plug 1 is arranged around the electric wire by passing the electric wire 6 from the main body 30 toward the first extending portion 33. Thereby, the first inner lip 32*a* from among the plurality of inner lips 32*a*, 32*b*, 32*c* is located at the nearest position to the terminal 5 and the first inner lip 32*a* is formed to have a lower projecting height than that of the second inner lip 32*b* and the third inner lip 32*c*.

According to the present invention, the projecting height of the first inner is formed smaller that that of the other inner lips 32*b* and 32*c*, so that it can be prevented that the inserting force of mounting the water seal plug 1 around the electric wire 6, that is a friction force, is totally increased. Thereby, the water seal plug 1 can be mounted easily at the electric wire 6. Enough amount of deformation of the second inner lip 32*b* and the third inner lip 32*c* against the electric wire 6, that is enough water-tightness, can be maintained. Therefore, even if a gap between the first inner lip 32*a* and the electric wire 6 is generated, high water-tightness for the electric wire 6 moving along the radial direction can be given by the other inner lips 32*b*, 32*c*.

When the projecting height of all inner lips 32*a*, 32*b*, 32*c* is increased, thereby a contact force of the inner lips 32*a*, 32*b*, 32*c* and the electric wire 6 becomes excessively high, the electric wire 6 can not be moved easily according to the motion of fastening the terminal 5 on the terminal block 8. Thereby, an excessive stress in the electric wire 6 and the terminal 5 may be generated. According to the present invention, the projecting height of the first inner lip 32*a* is formed smaller than that of the other inner lips 32*b*, 32*c* so as to decrease the contact force of the first inner lip 32*a* arranged at nearest position to the terminal 5 and the electric wire 6. Therefore, an area of the electric wire 6 contacted with the first inner lip 32*a* can be moved according to the motion of the terminal 5 so that the excessive stress in the electric wire 6 and the terminal 5 can be prevented.

The holder 7 is made of synthetic resin, and includes a holding portion 70 arranged in the terminal receiving section 41 and a pair of lock pieces 71 arranged outside the terminal receiving section 41 to lock with a projection 42 arranged at an outer surface of the connector housing 4.

The above structured connector 10 is assembled as following. After passing the electric wire 6 through the water seal plug 1, the insulation cover 62 of the electric wire 6 at the terminal end is removed so as to expose the core wire 61. The electric connecting portion 55 of the terminal 5 is connected with the terminal end of the electric wire 6. The terminal 5, the electric wire 6 and the water seal plug 1 are inserted into the terminal receiving section 41 of the connector. housing 4. And the holing portion 70 of the holder 7 is inserted in the terminal receiving section 41 and the pair of lock pieces 71 is engaged with the projection 42 of the connector housing 4, thus the connector 10 is assembled.

In the connector according to the present invention, the terminal 5 is held in the terminal receiving section 41 by the water seal plug 1 and the holder 7 as shown in FIG. 2. The terminal 5 has no lock structure to be locked with the connector housing 4, so that the terminal 5 can be easily removed from the connector housing 4. The connector 10 according to the present invention has good disassemblability and good recyclability.

While, in the embodiment, the present invention is described, it is not limited thereto. Various change and modifications can be made with the scope of the present invention.

The invention claimed is:

1. A water seal plug, which is arranged around an electric wire and inserted into a terminal receiving section of a connector housing of a connector so as to seal watertightly between an outer surface of the electric wire and an inner surface of the terminal receiving section, the connector having a terminal having an electric connecting portion connected with a mating member at one end of the terminal so as to be placed on the mating member and fastened by a fastening member and a wire connecting portion joined with a terminal end of the electric wire at the other end of the terminal, and the connector housing having the terminal receiving section receiving the terminal and the electric wire joined with the terminal movably along a radial direction of the electric wire parallel to a direction of fastening by the fastening member, the water seal plug comprising:

a cylindrical main body passing the electric wire therethrough; and a water seal member made of elastic material, having an ring-shape outer lip projecting from an outer surface of the main body and abutting on an inner surface of the terminal receiving section; and a plurality of ring-shape inner lips projecting from an inner surface of the main body and abutting on an outer surface of the electric wire, wherein at least one of the plurality of inner lips has a lower projecting height from the inner surface of the main body than that of the other inner lips, wherein the inner lip at the nearest position to the terminal from among the plurality of inner lips is formed to have a lower projecting height from the inner surface of the main body than that of the other inner lips.

2. The water seal plug according to claim 1 further comprising:

a resin member made of synthetic resin and formed integrally with the water seal member, wherein the resin member comprises:

a cylindrical portion having a cylindrical shape and being arranged coaxially with the main body so as to pass the electric wire therethrough; and a limiting portion projecting from an inner surface of the cylindrical portion and abutting the electric wire to be moved along the direction of fastening when the electric connecting portion is fastened by the fastening member so as to prevent the electric wire from excessively moving.

3. A connector, comprising:

a terminal having an electric connecting portion connected with a mating member at one end of the terminal so as to be placed on the mating member and fastened by a fastening member and a wire connecting portion joined with a terminal end of the electric wire at the other end of the terminal, and a connector housing having a terminal receiving section receiving the terminal and the electric wire joined with the terminal movably along a radial direction of the electric wire parallel to a direction of fastening by the fastening member, and a water seal plug arranged around the electric wire and inserted into the terminal receiving section so as to seal watertightly between an outer surface of the electric wire and an inner surface of the terminal receiving section, and the water seal plug being according to claim 1.

4. A connector, comprising:

a terminal having an electric connecting portion connected with a mating member at one end of the terminal so as to be placed on the mating member and fastened by a fastening member and a wire connecting portion joined with a terminal end of the electric wire at the other end of the terminal, and a connector housing having a terminal receiving section receiving the terminal and the electric wire joined with the terminal movably along a radial direction of the electric wire parallel to a direction of fastening by the fastening member, and a water seal plug arranged around the electric wire and inserted into the terminal receiving section so as to seal watertightly between an outer surface of the electric wire and an inner surface of the terminal receiving section, and the water seal plug being according to claim 2.

* * * * *